US006527150B2

(12) United States Patent
Benoist

(10) Patent No.: US 6,527,150 B2
(45) Date of Patent: Mar. 4, 2003

(54) DEVICE FOR DISPENSING A PRODUCT USING PROPELLANT PACKAGED SEPARATELY FROM THE PRODUCT

(75) Inventor: Jean-François Benoist, Lagny/Marne (FR)

(73) Assignee: L'Oreal S.A., Paris (FR)

( * ) Notice: Subject to any disclaimer, the term of this patent is extended or adjusted under 35 U.S.C. 154(b) by 45 days.

(21) Appl. No.: 09/736,302

(22) Filed: Dec. 15, 2000

(65) Prior Publication Data

US 2001/0015359 A1 Aug. 23, 2001

(30) Foreign Application Priority Data

Dec. 15, 1999 (FR) ..... 99 15820

(51) Int. Cl.[7] ..... B65D 83/14
(52) U.S. Cl. ..... 222/402.1; 222/1
(58) Field of Search ..... 222/1, 402.1

(56) References Cited

U.S. PATENT DOCUMENTS 3,984,498 A * 10/1976 McChesney et al. ..... 260/879
4,969,577 A 11/1990 Werding
5,032,619 A * 7/1991 Frutin et al. ..... 222/402.1 X
5,060,823 A * 10/1991 Perlman ..... 222/402.1 X
5,098,291 A * 3/1992 Curtis et al. ..... 222/402.13 X
5,256,400 A 10/1993 Froix et al.
5,865,351 A 2/1999 De Laforcade
6,119,897 A * 9/2000 Boileau ..... 222/402.1 X
6,230,943 B1 * 5/2001 Miyamoto et al. ... 222/402.1 X

FOREIGN PATENT DOCUMENTS

| | | |
|---|---|---|
| CH | 676 585 | 2/1991 |
| EP | 502 678 | 9/1992 |
| EP | 0 569 590 | 11/1993 |
| JP | 9-104487 | * 4/1997 |

OTHER PUBLICATIONS

JP9–104487–A, first publication Apr. 22, 1997, Derwent Translation on Jan. 10, 2003, pp. 1–58.*

* cited by examiner

*Primary Examiner*—Kenneth Bomberg
(74) *Attorney, Agent, or Firm*—Finnegan, Henderson, Farabow, Garrett & Dunner LLP

(57) ABSTRACT

A device for packaging a product, particularly a cosmetic product, and for dispensing it under pressure includes a container which, at least in part, is translucent or transparent. The container delimits two compartments separated from one another in a sealed fashion. A first compartment is in communication with a valve fitted to the device, and contains the product to be dispensed under pressure. A second compartment contains a propellant in the form of a liquefied gas. A retainer is provided inside the second compartment and is capable of trapping the liquid phase of the propellant, the retainer having at least one portion which is permeable to the gaseous phase of the propellant.

23 Claims, 2 Drawing Sheets

Figure 1:
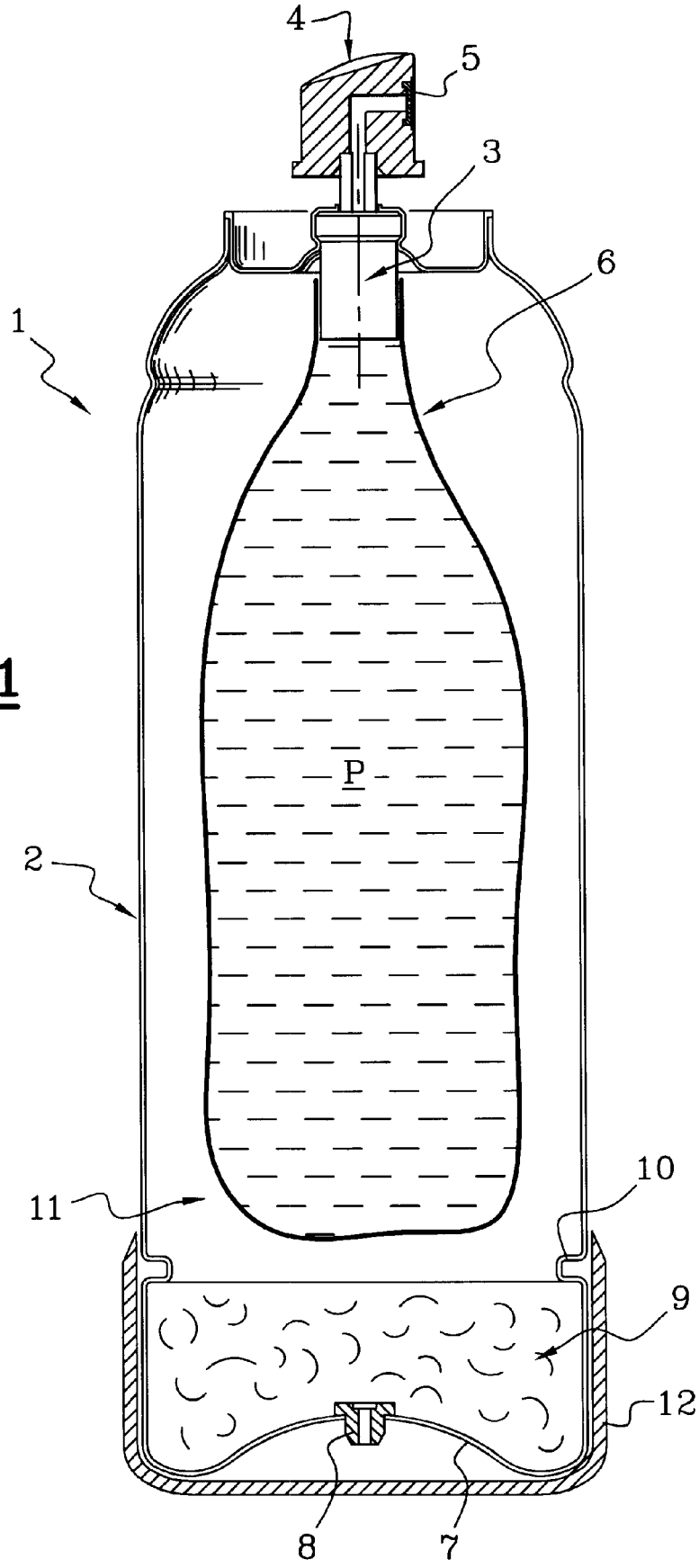

DEVICE FOR DISPENSING A PRODUCT USING PROPELLANT PACKAGED SEPARATELY FROM THE PRODUCT

The present invention relates generally to a unit for packaging a product, particularly a cosmetic product which may, for example, be in the form of a spray or of a foam or mousse, and for dispensing it under pressure. More particularly, the invention relates to devices of the type having a propellant kept separate from the product that is to be dispensed, for example, via a flexible-walled pouch or a moving piston.

In the field of cosmetics, certain products, particularly those to be dispensed in the form of a spray or of a foam or mousse, contain a liquefied gas. With such products, it is sometimes necessary to package them separately from the propellant intended to keep them under pressure. To do this, the product may be packaged in a flexible-walled pouch in communication with a valve, which is generally surmounted by a push-button for actuating the valve. The propellant gas is packaged in a volume formed between the exterior surface of the pouch and the interior wall of an outer body, generally of cylindrical shape. This volume is filled with propellant gas via a filling valve generally arranged in the bottom of the outer body.

Alternatively, the product is kept separate from the propellant gas by means of a piston capable of sliding in sealed contact against the interior surface of the body of the device. The piston can be introduced into the device via an attached bottom of the outer body.

In order to obtain the desired "crushing" of the pouch, by collapsing its walls, or to obtain the required advance of the piston, such a system requires that throughout the life of the device, that is to say from first use to last use, the pressure exerted by the propellant be higher than the vapor pressure of the product. The opposite situation could lead to pouch inflation, which could go so far as to burst the pouch, or to force the piston backwards inside the cylindrical body.

A first solution might entail using a compressed gas by way of propellant. In order to have sufficient pressure at the end of use of the device, this solution would necessitate a very high initial pressure, which might be incompatible with legislation in this field. Furthermore, in the case of a container made of thermoplastic material, the variation in pressure which would be generated between the first use and the last use would be prejudicial to the overall performance of the device.

Another potential solution might involve using a liquefied gas as the propellant, for example, a butane, a propane, or a dimethyl ether. A liquefied gas is a gas which includes both a liquid phase and a vapor phase above the liquid phase. This solution, although satisfactory from the point of view of the pressurization it allows, is not without its drawbacks. Specifically, when the outer body of the device is translucent or transparent, enabling one to see how much product is left to be used, consumers see liquid "wandering"freely in the volume between the flexible pouch and the outer body of the device. This is perceived in a negative light by consumers who imagine that the pouch is not entirely leak-tight and/or that they will not be able to use up all of the product they have purchased.

U.S. Pat. No. 5,256,400 describes a dispensing apparatus including a polymeric material having an array of pores in which a compressed gas, dissolved in a solvent, is trapped, so as to increase the amount of compressed gas that can be placed in the container that is to be pressurized.

EP-A 0 569 590 discloses dissolving a compressed gas in a sorption agent so as to increase the amount of compressed gas that can be placed in a container that is to be pressurized.

According to one aspect of the invention, a device for dispensing a product includes a container having an interior including a first compartment and a second compartment. The first and second compartments are separated from one another in a sealed manner. At least part of the container is either translucent or transparent.

The first compartment of the dispensing device contains a product and is in communication with a valve. The second compartment is provided with a propellant having a gaseous phase and a liquid phase. In addition, the second compartment includes a retainer configured to trap the liquid phase of the propellant. At least a portion of the retainer is permeable to the gaseous phase of the propellant.

Preferably, the liquid phase of the propellant gas is retained inside the retainer so that it is not possible to see liquid in the free state through the transparent or translucent part (i.e., walls) of the container. The consumer, looking through the transparent or translucent walls, preferably sees only the first compartment which is arranged inside the container and whose volume diminishes with use.

In addition, in the liquefied state, a single drop of gas may be enough to pressurize the container, which limits the drawbacks affecting the environment and associated with the use of certain "harmful" gases, the drawbacks of which are recalled in U.S. Pat. No. 5,256,400 discussed hereinabove.

Furthermore, there may be limited contact between the liquid phase and the means separating the two compartments, whether this be a flexible-walled pouch or a moving piston. Likewise, contact between the liquid phase of the propellant and the body of the container may be mainly in the zone facing the retainer. This may reduce the risk of degradation of the materials used in such devices, particularly the materials for producing the means separating the two compartments in sealed fashion.

The propellant may be a hydrocarbon, for example, a butane, a propane, a chlorofluorocarbon (CFC), a fluorocarbon, or a dimethyl ether.

According to a first preferred embodiment, the first compartment is delimited by a flexible-walled pouch. A pouch such as this may be made of a complex which may include a layer of metal, for example, aluminum, and at least one layer of a thermoplastic, for example, a polyamide, polyethylene, or polypropylene. The walls of the pouch can collapse with successive dispensing operations under the effect of the pressure obtained outside the pouch.

Alternatively, the first compartment may be separated from the second compartment in a sealed fashion by a moving piston. The piston is able to slide in sealed contact against the interior surface of the container, thus delimiting an upper volume containing the product that is to be dispensed and a lower volume containing the propellant gas.

In one preferred embodiment, the container is of cylindrical or spherical shape. In another preferred embodiment, the retainer is placed in the bottom of the container.

The retainer may be immobilized inside the container by a stop. Alternatively, the retainer may be bonded or welded into the second compartment. Other means of attachment may also be envisaged.

The retainer may be formed of a block of open-cell or semi-open-cell foam, of a felt, of a porous membrane located some distance from the bottom of the container, or of a sintered material. By way of example, use is made of a polyurethane foam of the type marketed by the company RECTICEL® under the reference POTTSCORER 430®. Also by way of example, the retainer may be made of silicone. The configuration of the retainer, for example, its dimensions and/or its absorption characteristics, are chosen to suit the maximum volume of liquid that it is to contain. Preferably, complete saturation of the retainer is avoided, because this may significantly reduce its ability to actually retain the liquid it contains.

The outer container may be made of thermoplastic. By way of example, use may be made of a polyethylene terephthalate (PET), a polyethylene naphthalate (PEN), a polybutadiene (PBT), or a blend of such thermoplastics.

In a preferred embodiment, the product placed inside the first compartment may contain a liquefied gas, so that when dispensed via the valve the product forms a foam or mousse, a gel, a cream, for example, a care cream, a milk, or a spray. By way of example, the product may be a shaving foam, a deodorant spray, a care cream, or a hair care product, for example, a hairspray, a lacquer, or a hair styling mousse.

Another aspect of the invention provides a method of dispensing a product to a surface region, for example, an external body portion. The external body portion may include hair, skin, a combination of hair and skin, and the like. The method includes providing the dispensing device, actuating a valve to dispense product from the device, and directing the dispensed product to a surface region. Preferably, the product is hair care product, skin care product, or other cosmetic product.

Apart from the provisions explained hereinabove, the invention may include a certain number of other arrangements which will be dealt with more fully hereinafter with regard to some embodiments which are described with reference to the drawings appended hereto, but which are not in any way limiting. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a side, cross-sectional view of a dispensing device according to a first preferred embodiment of the invention, and FIG. 2 is a side, cross-sectional view of a dispensing device according to a second preferred embodiment of the invention.

Reference will now be made in detail to the present preferred embodiments of the invention, examples of which are illustrated in the accompanying drawings. Wherever possible, the same reference symbols are used in the drawings and the description to refer to the same or like parts.

Figure 2:
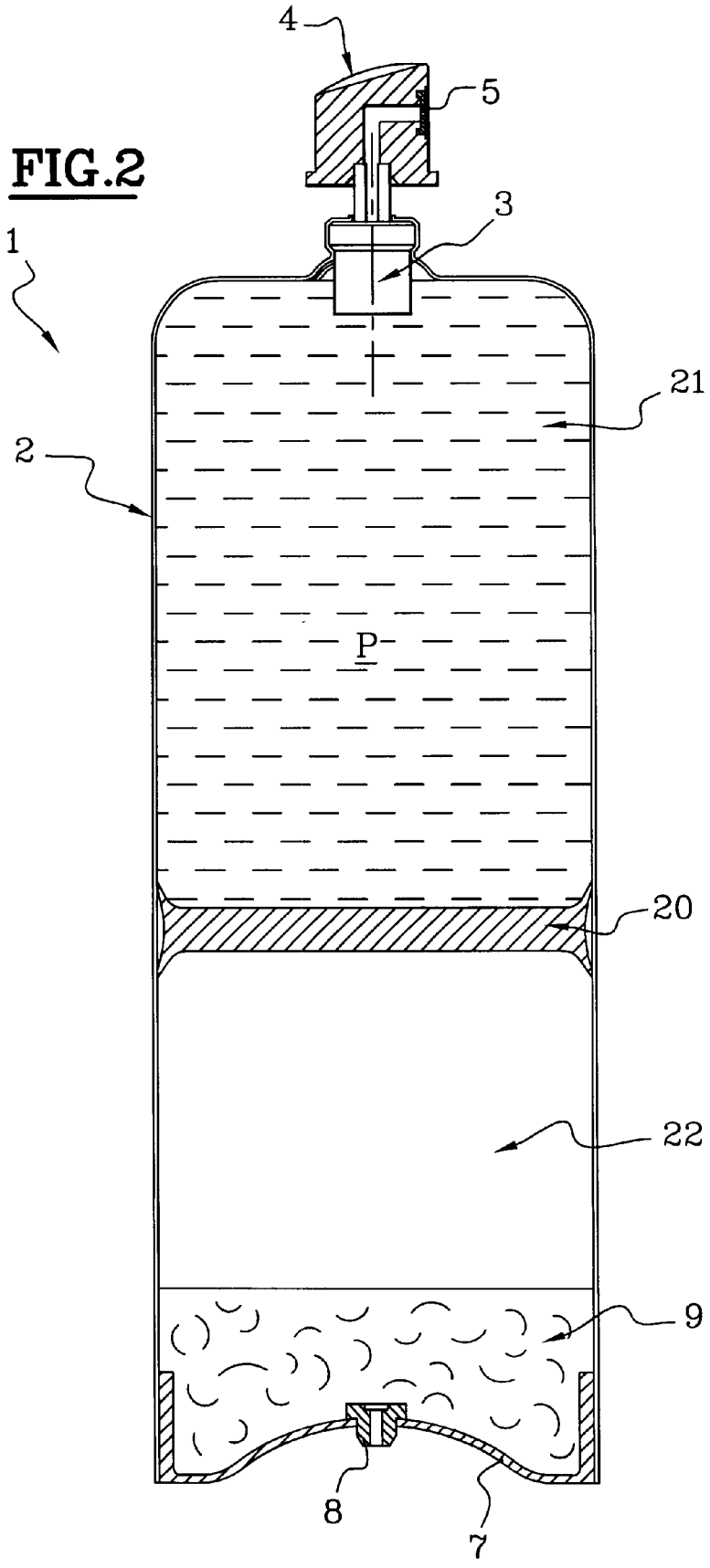

As depicted in FIG. 1, a device 1 for packaging a product and dispensing the product under pressure includes a cylindrical outer container 2. The container 2 is preferably made of a transparent thermoplastic, such as a PET, PEN, PBT, or a blend of at least two of PET, PEN, and PBT. A valve 3 is mounted on one end of the container 2. The valve 3 is equipped with a push-button 4 for actuating the valve and dispensing the product, for example in the form of a foam or mousse or of a spray, via an outlet orifice 5. An inlet orifice (unnumbered) of the valve is in liquid communication with a flexible-walled pouch 6 formed, for example, of a thermoplastic/metal complex. A product P to be dispensed is contained in the pouch. The product P may optionally be a mixture including a liquefied gas.

The bottom end 7 of the container 2 is closed, for example, by a concave bottom wall. The bottom end 7 includes a filling valve 8 capable of receiving a propellant by, for example, filling using a needle. A retainer 9 is arranged in the bottom end 7 of the container 2. In an exemplary embodiment, the retainer 9 is a block of open-cell foam. The retainer 9 is axially immobilized by a stop in the form of an annular collar 10 formed by the body of the container 2. Thus, a volume 11 is formed between the outer surface of the flexible-walled pouch 6 and the interior surface of the outer container 2. Arranged inside this volume 11, the open-cell foam retainer 9 contains the liquid phase of a liquefied gas, for example, an isobutane. In operation, the liquefied gas vaporizes above the retainer 9 and exerts sufficient pressure on the exterior walls of the pouch 6 so as to pressurize the product P contained therein.

The device 1 according to the exemplary embodiment which has just been described can be assembled as follows. Once the body of the container 2 has been produced, for example, by extrusion-blow-molding, a cylinder 9 of foam is lowered into the bottom of the container until it is positioned behind the annular collar 10. Next, the valve 3, secured to the flexible pouch 6, is mounted on the open end of the container 2. The push-button 4 can then be positioned on the valve stem.

The device 1 is then inverted and the necessary amount of liquefied gas is introduced through the filling valve 8 and is absorbed and retained in the open cells of the foam retainer 9. The liquid gas vaporizes above the retainer 9 in response to the pressure inside the volume 11 and spreads out all around the flexible pouch 6, thus exerting uniform pressure on its walls. The product P contained in the pouch 6 is thus adequately pressurized. Each time the valve 3 is actuated via the push-button 4, the product P comes out under pressure, for example, in the form of a spray or of a foam or mousse. Each time the product P is dispensed, the pressure existing in the volume 11 decreases, which preferably causes vaporization of a corresponding amount of liquefied gas contained in the retainer 9 and maintenance of adequate pressure throughout the life of the product. When looking through the transparent or translucent part of the container, the user preferably sees almost no liquid contained freely in the volume 11. This is because most of the liquid 40 gas is preferably retained in the open cells of the foam retainer 9. Thus, liquid does not come into contact with the walls of the pouch 6 or into contact with the walls of the container 2.

After filling the retainer 9 with a predetermined amount of the propellant gas, a cover 12 which is preferably not transparent can be attached to the outside of the container 2, near the bottom end 7 of the device 1, so as to conceal the retainer 9. The cover 12 may be force-fitted, bonded, welded, screwed on, or the like.

As shown in FIG. 2, a second preferred embodiment uses a piston to seal the first compartment from the second compartment. A piston 20 is mounted inside the container 2 and is movable between the bottom end 7 and the valve 3. The piston 20 bears against the interior wall of the container 2 in a sealed fashion, thereby separating an upper compartment 21 containing the product P to be dispensed under pressure from a lower compartment 22 containing the propellant. The upper compartment 21 which contains the product P to be dispensed is in communication with the valve 3, while the lower compartment 22 includes a retainer 9, for example, a block of open-cell foam.

In the same way as in the previous embodiment, the retainer 9 contains a liquefied gas which, by vaporizing in the lower compartment 22, allows the product P contained in the upper compartment 21 to be pressurized via the piston 20. The bottom end 7 of the container 2 is an attached bottom, fixed, for example, by welding or bonding. The bottom end 7 also includes a filling valve 8 for introducing the liquefied gas into the retainer 9. In the same way as in the previous embodiment, the liquid phase of the gas is essentially contained inside the retainer 9 and is therefore not visible from the outside of the at least partially-transparent container 2.

In the foregoing detailed description, reference was made to some preferred embodiments of the invention. It is obvious that variations can be made thereto without departing from the spirit of the invention as claimed hereinafter.

What is claimed is:

1. A device for dispensing a product, comprising:

a container having an interior including a first compartment and a second compartment separated from one another in a sealed manner, at least part of the container being one of translucent and transparent;

a valve in communication with the first compartment;

a product contained in the first compartment;

a propellant present in the second compartment in a form of both a gaseous phase and a liquid phase; and a retainer provided in the second compartment, the liquid phase of the propellant being trapped in the retainer, and at least a portion of the retainer being permeable to the gaseous phase of the propellant.

2. The device according to claim 1, wherein the propellant is one of a butane, a propane, a chlorofluorocarbon (CFC), a fluorocarbon, and a dimethyl ether.

3. The device according to claim 1, further comprising a flexible-walled pouch defining the first compartment.

4. The device according to claim 3, wherein the pouch comprises a layer of a metal and at least one layer of a thermoplastic.

5. The device according to claim 4, wherein the metal comprises aluminum.

6. The device according to claim 4, wherein the thermoplastic comprises one of a polyamide, a polyethylene, and a polypropylene.

7. The device according to claim 1, further comprising a movable piston separating the first compartment from the second compartment.

8. The device according to claim 1, wherein the retainer is arranged in a bottom of the container.

9. The device according to claim 1, further comprising means for immobilizing the retainer inside the container.

10. The device according to claim 1, wherein the retainer is formed of one of a felt, a porous membrane located a distance from a bottom of the container, and a sintered element.

11. The device according to claim 1, wherein the retainer comprises one of a block of open-cell foam and a block of semi-open-cell foam.

12. The device according to claim 1, wherein the container comprises a thermoplastic material.

13. The device according to claim 12, wherein the thermoplastic material comprises one of a polyethylene terephthalate (PET), a polyethylene naphthalate (PEN), a polybutadiene (PBT), and a mixture of at least two of PET, PEN, and PBT.

14. The device according to claim 1, wherein the product contained in the first compartment includes a liquefied gas so that, when dispensed via the valve, the product forms one of a foam, a mousse, a milk, a gel, a cream, a care cream, and a spray.

15. The device according to claim 1, wherein the product is a cosmetic product.

16. The device according to claim 1, further comprising a stop configured to immobilize the retainer in the container.

17. The device according to claim 1, wherein the container includes at least one wall formed of at least one of translucent material and transparent material permitting a visual determination of the amount of the product in the first compartment.

18. The device according to claim 1, wherein the product is one of a shaving foam, a deodorant spray, and a hair care product.

19. The device according to claim 1, wherein the product is a hair care product chosen from one of a hairspray, a lacquer, a care cream, a gel, and a hair styling mousse.

20. A method of dispensing a product, comprising:

providing the device of claim 1;

actuating the valve to dispense product from the device; and directing the dispensed product to a surface region.

21. The method of claim 20, wherein the surface region is an external body portion.

22. The method of claim 20, wherein the product is one of a shaving foam, a deodorant spray, and a hair care product.

23. The method of claim 21, wherein the external body portion includes hair and wherein the product is a hair care product chosen from one of a hairspray, a lacquer, a care cream, a gel, and a hair styling mousse.

* * * * *

UNITED STATES PATENT AND TRADEMARK OFFICE

CERTIFICATE OF CORRECTION

PATENT NO. : 6,527,150 B2
DATED : March 4, 2003
INVENTOR(S) : Benoist

It is certified that error appears in the above-identified patent and that said Letters Patent is hereby corrected as shown below:

Title page,
Item [*] Notice, delete the phrase "by 45" and insert -- by 0 days --

Signed and Sealed this

Thirty-first Day of May, 2005

JON W. DUDAS
*Director of the United States Patent and Trademark Office*